US006588881B2

(12) United States Patent
Akase et al.

(10) Patent No.: US 6,588,881 B2
(45) Date of Patent: Jul. 8, 2003

(54) INK PRINTER

(75) Inventors: Tokuya Akase, Chiba (JP); Hiroyuki Muramatsu, Chiba (JP); Seiji Kuwahara, Chiba (JP); Tatsuro Sato, Chiba (JP); Kouji Kawaguchi, Chiba (JP); Shunichi Tanaka, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/822,054

(22) Filed: Mar. 30, 2001

(65) Prior Publication Data

US 2002/0044173 A1 Apr. 18, 2002

(30) Foreign Application Priority Data

Apr. 3, 2000 (JP) ..... 2000-101391

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS 5,619,234 A * 4/1997 Nagato et al. ..... 347/55

* cited by examiner

*Primary Examiner*—Raquel Yvette Gordon
(74) *Attorney, Agent, or Firm*—Adams & Wilks

(57) ABSTRACT

A print head has a reduced power size or increased print speed that can be operated at a lower voltage or higher speed and can maintain high-quality output printing free from thinned portions. During intervals between printing operations while a print paper is being fed, pulses are applied to all print electrodes to maintain a uniform potential difference between each of the print electrodes and a counter electrode so that an electric charge is supplied to the ink meniscus. Consequently, a sufficient Coulomb force to permit ink droplets to be ejected is obtained. Therefore, during printing operations, the supplied energy can be reduced and electric charge on the ink surface can be retained. Hence, ink droplets can be ejected stably without nonuniformities.

20 Claims, 5 Drawing Sheets

DEVICE FOR DRIVING THE TRANSFER MECHANISM

INK PRINTER

BACKGROUND OF THE INVENTION

The present invention relates to an ink-printer capable of printing various output images on paper to satisfy a wide variety of needs, ranging from high-quality, high-speed printing in the printing industry to needs of office and personal printer fabrication industry and even to general-purpose economical, consumer output devices using various kinds of paper.

A conventional ink-printer as disclosed in Japanese Patent Laid-Open No. 167465/1981 and making use of an electrostatic force (Coulomb force) has been proposed. This printer has a lower plate on which print electrodes are arranged for individual dots. An insulative upper plate forms a single opening in the form of a slit. This opening is filled with ink. A counter electrode is placed opposite to the print electrodes through the opening such that a slight gap is left between the counter electrode and each print electrode. A pulsive voltage is applied between the counter electrode and each print electrode. Thus, a Coulomb force is applied to ink to squirt it toward the counter electrode. Therefore, the print head is simple in structure. Only a pattern of the print electrodes is required. Since the ink travels along the lines of electric force of the electric field produced between each print electrode and the counter electrode while the charged ink is undergoing a Coulomb force, it is not necessary to partition the opening in the print head by nozzles.

In this conventional printer, ink can be squirted from any arbitrary position even in the opening in the form of a slit. Furthermore, the structure is simple. Hence, the fabrication cost can be curtailed. However, the printer of this structure has the following problems.

(1) Before printing is started, a pulsed voltage pulse for producing a potential difference between mutually opposite electrodes is not applied. Therefore, the ink is hardly electrically charged. After a printing operation has progressed to some extent, or during the printing operation, electric charge is gradually accumulated on ink. Accordingly, the amount of electric charge on the ink differs between the initial state and a state in which a printing operation has progressed to some extent. Therefore, if a print pulse is applied, the Coulomb force exerted on the ink differs according to the state. Consequently, produced ink dots become nonuniform in size. Especially, under the initial state, ink droplets may not be squirted, resulting in dropouts. Alternatively, the dot diameters decrease. In this way, nonuniform ink dots are formed on the paper. As a result, the output image suffers from nonuniformities and thinned portions.

(2) When the print head is being driven at regular intervals, if a long interval time is established to permit a mechanical operation such as paper feeding or serial scan of the head, the amount of charge on the ink attenuates greatly. Therefore, if a print pulse is then applied, the amount of charge on the ink is insufficient in the same way as in (1). Consequently, a sufficient Coulomb force is not obtained. Ink droplets are not easily ejected. The output image suffers from dropouts and thinned portions. In this way, the print quality cannot be assured.

(3) Furthermore, electric charge left on the surface of the ink meniscus is attenuated during a quite short interval between successively applied print pulses. Therefore, the print pulses must always maintain an energy to permit ink to be squirted stably from this attenuated state. Consequently, the voltage value of the print pulses is set high, or the pulse width is set longer, to secure the necessary energy. For this reason, it has been difficult to reduce the driving voltage used for the print head. That is, it has been difficult to reduce the size of the power supply and to accomplish power savings. In addition, this has been a great obstacle in shortening the pulse width, i.e., in shortening the drive time. That is, increase in the print speed has been greatly hindered.

SUMMARY OF THE INVENTION

Accordingly, it is an object of the present invention to provide a small-sized printer which offers savings in power consumption, can provide an improved print speed, and can maintain high output print quality (i.e., free from nonuniformities and thinned portions due to dropouts).

An ink-printer in accordance with the present invention prints on a recording medium by extracting ink from an opening by an electrostatic force, the printer comprising: plural print electrodes arranged near the opening; a counter electrode located opposite to the print electrodes via a quite narrow gap; a driver circuit for selectively applying print pulses to the print electrodes; and a charge supply means for supplying desired electric charge to ink existing near the opening.

In one feature of the invention, there is further provided a conveyor mechanism for conveying the recording medium positioned between the counter electrode and the opening. When the recording medium is being scanned by the conveyor means, the charge supply means applies a uniform potential difference between each print electrode and the counter electrode, thus previously supplying desired electric charge to the ink in the opening.

In another feature of the invention, the charge supply means applies a voltage pulse that gives a uniform potential difference between each of the print electrodes and the counter electrode at least once immediately before application of the print pulses, thus previously supplying desired electric charge to the ink in the opening.

DESCRIPTION OF THE PREFERRED EMBODIMENTS

The preferred embodiments of the present invention are hereinafter described with reference to the accompanying drawings.

(Embodiment 1)

Figure 1:
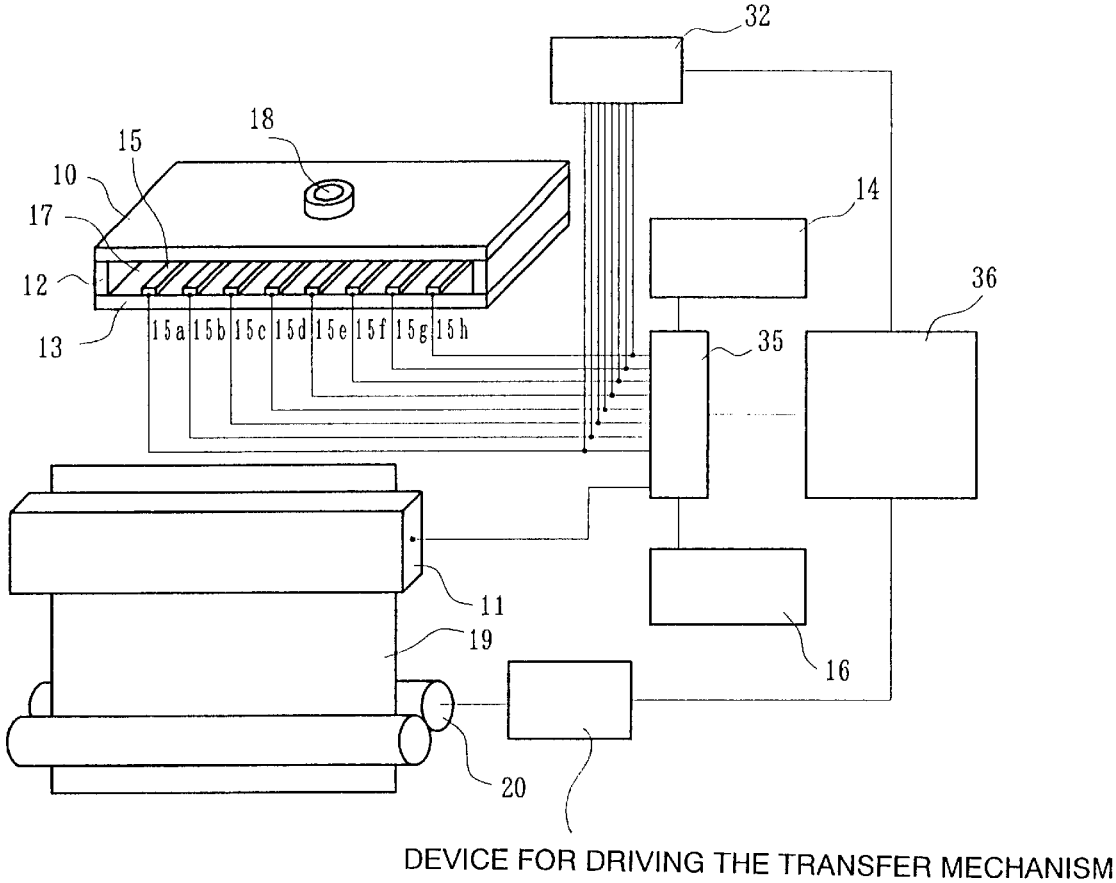
FIG. 1 is a block diagram of a printer in accordance with the present invention, particularly showing its print head.

The structure of a printer including a print head in accordance with the present invention is described by referring to FIG. 1. The print head comprises an insulative lower head plate 13, a spacer 12 formed on the lower head plate 10 formed on the spacer 12. The spacer 12 has at least on side that is open and permits plural print electrodes 15*a*–15*h* to be disposed at regulate intervals on the lower head plate 13. In this structure, a slit opening 17 is formed at one end surface of the print head. An ink chamber is formed between the lower head plate 13 and the upper head plate 10. The upper head plate 10 is provided with an ink supply entrance 18. Ink is injected from an ink supply means (not shown) and constantly undergoes appropriate pressure. Therefore, the ink is forced into the ink chamber, filling the slit opening 17. In this way, the ink forms a convex meniscus.

Each print electrode 15*a*–15*h* is connected with a printer electrode voltage source 14 via a driver circuit 35. This driver circuit 35 is so set that it receives instructions form a control circuit 36 and performs a printing operation. A charge supply means 32 is connected with each print electrode 15. The driver circuit 35 operates in synchronism with the printing operation under control of the control circuit 36. In the present embodiment, the charge supply means 32 is made of a pulse-generating circuit for producing constant-voltage pulses. The charge supply means 32 can apply voltage pulses at a desired potential to the printing electrodes 15*a*–15*h*. This desired potential is set to a value different from the potential at a counter electrode 11 (described later). In this way, the charge supply means 32 can give a uniform potential difference between each print electrode and the counter electrode.

Since the pint head is constructed as described above, the print electrodes 15*a*–15*h* can selectively apply voltage pulses according to desired image data, whereby they can perform a desired printing operation. Voltage pulses for the supply of electric charge can also be applied.

The aforementioned counter electrode is spaced a given distance of about 0.5 to 1.5 mm from the slit opening 17 in the print head. Paper 19 conveyed by a conveyor means 20 is placed in this gap between the counter electrode and the slit opening 17. The conveyor means 20 uses a friction feed mechanism or the like having a pair of rollers. The conveyor means places the paper 19 in the quite narrow gap formed between the print head and the counter electrode 11. After setting the print position, an auxiliary scanning operation is performed in synchronism with printing operation of the print head.

The aforementioned counter electrode 11 is connected with the counter electrode voltage source 16 via the driver circuit 35. Voltage pulses at a potential different from the potential at the print electrodes 15 are applied to the counter electrode 11 in synchronism with the printing operation of the print electrodes.

The operation of the printer including the print head constructed in this way is described. A fundamental printing operation for one line is first described. Data indicated by an image signal is converted into other appropriate data form and supplied into the driver circuit 35. Within this driver circuit 35, data about one line of dots is placed into a shift register. The driver circuit 35 performs a driving operation in accordance with a control signal from the control circuit 36. This driving operation selectively applies desired voltage pulses to the print electrodes 15 according to the image signal. Since the potential of the voltage pulses applied to the print electrodes 15 is set different from the potential at the counter electrode 11, an electric field is developed between both electrodes. Ink interposed between both electrodes is polarized according to this static electric field. Electric charge is accumulated on the surface of the ink. At the same time, a Coulomb force is exerted on the ink by the electric field set up between both electrodes. The ink is attracted toward the counter electrode along the electric field and adheres to a recording medium on its way. In this manner, dots of ink are printed. In this principle, ink is ejected from arbitrary positions in the slit opening 17. In consequence, one line of dots of ink is printed on the paper 19.

After the end of printing of one line of dots, the control circuit 36 sends a control signal to the conveyor means 20 to operate it, for causing the paper 19 to move a given distance in the direction of the auxiliary scan. At the same time, the control circuit 36 sends a control signal to the charge supply means 32 to apply charge supply pulses to all the print electrodes to prevent the amount of charge on the ink from being attenuated. A given amount of charge on the ink is maintained until the next line of dots is started to be printed.

Figure 2A:
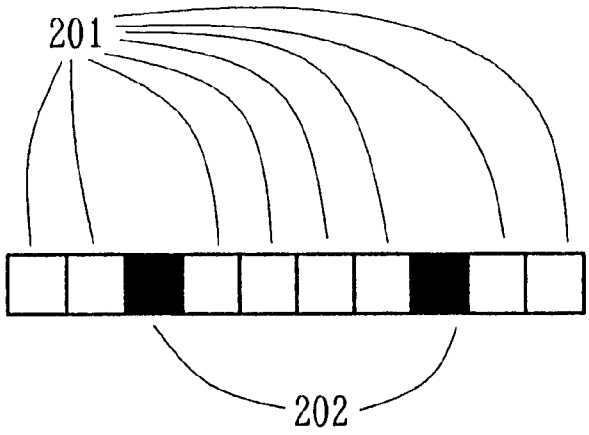
FIGS. 2A–2D are diagrams illustrating a fundamental operation for squirting ink in accordance with the invention.
Figure 2B:
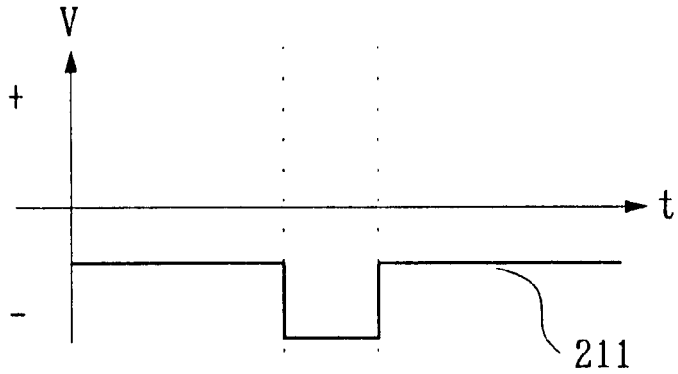
Figure 2C:
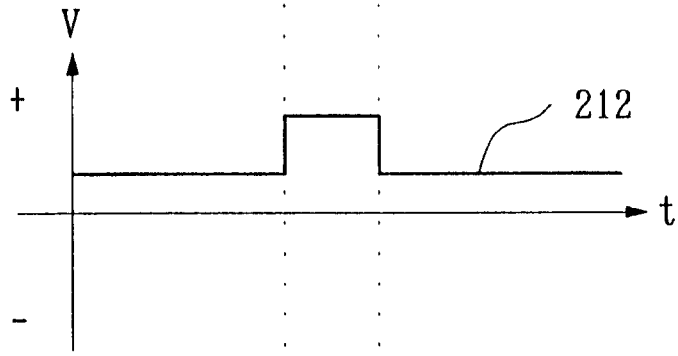
Figure 2D:
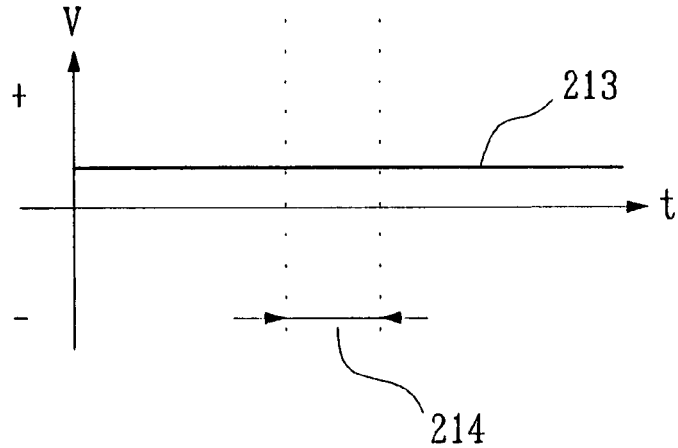

The operation of this print head during this printing operation is next described in detail by referring to FIGS. 2A–2D and 3A–3B. FIGS. 2A–2D illustrate the fundamental operation for squirting a jet of ink in accordance with the present invention. FIG. 2A shows one line of dots to be printed in the direction of the main scan. In this example, no dots are printed in positions 201. Dots are printed in positions 202. FIG. 2B shows the voltage at the counter electrode. Variations of the voltage with time (t), i.e., taken on the time-axis, are indicated by 211. FIG. 2C shows the voltage at an electrode position corresponding to an unselected position 201. Variations of the voltage taken on the time-axis (t) are indicated by 212. FIG. 2D shows the voltage at an electrode position corresponding to a selected position 202. Variations of the voltage taken on the time-axis (t) are indicated by 213.

The potential difference (213–211) between the selected electrode and the counter electrode is made different from the potential difference (212–211) between the unselected electrode and the counter electrode during the print period 214. The balanced state of the electric fields created by the surrounding electrodes is upset in the position of the selected electrode 202. Consequently, ink droplets are squirted, thus printing dots.

Figure 3A:
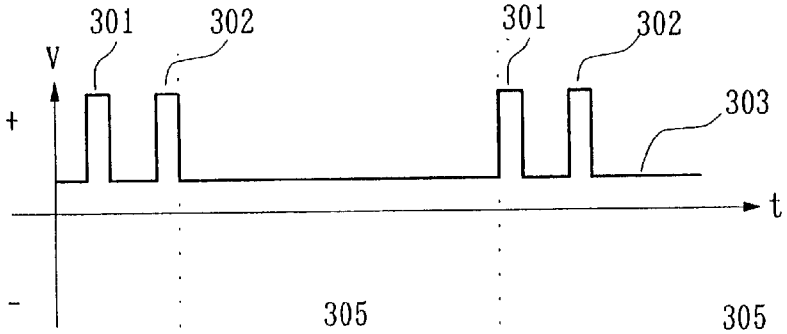
FIGS. 3A and 3B are timing charts illustrating a sequence of operations performed to drive a print head in accordance with Embodiment 1 of the invention.
Figure 3B:
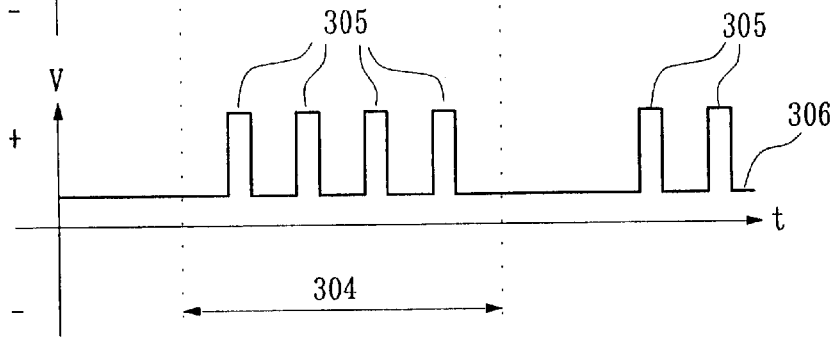

FIGS. 3A and 3B are timing charts illustrating a sequence of operations performed to drive the print head in accordance with Embodiment 1 of the present invention. The operations are hereinafter described by referring to FIGS. 3A and 3B.

Where the opening through which ink is squirted is open like a slit as in the present print head, the operation is easily affected by interference between adjacent electrodes. If one line were printed in one operation, the squirting characteristics of ink would become unstable. In the present invention, therefore, adjacent electrodes are not selected simultaneously. If all dots in the direction of the main scan should be printed, the odd-numbered electrodes are selected and corresponding dots are printed, and then the even-numbered electrodes are selected and corresponding dots are printed. Note that the number of division is not limited to this.

The print head in accordance with Embodiment 1 drives even-numbered print electrodes and odd-numbered print electrodes with a time difference in the same way as in the foregoing. That is, the printer divides one line into two parts and drives the corresponding two sets of electrodes successively.

FIG. 3A shows voltage pulses applied to the unselected print electrodes 15 during printing operation. These voltage pulses are referred to as the print pulses. In this example, print pulses for driving the odd ones of the print electrodes are referred to as print pulses 301. Print pulses for driving the even ones of the print electrodes are referred to as print pulses 302. Variations of the voltage taken on the time-axis (t) are indicated by 303. The line to be printed is shifted to the next after the conveyor means 20 performs an auxiliary scanning operation. This time interval is referred to as interval 304.

FIG. 3B illustrates a method of operating the charge supply means 32 in Embodiment 1. Voltage pulses for supplying electric charge to all the print-electrodes are referred to as charge supply pulses 305. Variations of the voltage taken on the time-axis (t) are indicated by 306. As shown in this figure, the charge supply pulses 305 are applied during the interval 304.

The operation is next described. Print pulses 301 and 302 are applied to cause the head to print one line. After completion of the printing operation for one line, the conveyor means 20 scans the paper 19 in the direction of auxiliary scan to bring the paper 19 into the next print position. During this interval 304, the charge supply means 32 applies charge supply pulses 305 to all the print electrodes to hold the electric charge on the surface of ink. Thus, a uniform electric field is produced between each print electrode 15 and the counter electrode 11. The charge supply pulses 305 are cut off immediately before the next line is printed. Then, the operation for printing of the next line is carried out. These operations described thus far are repeated. Consequently, the electric charge on the surface of ink that is necessary to squirt the ink is maintained at all times without causing little attenuation. Hence, ink is reliably squirted. High-quality output free from dropouts or thinned portions is accomplished.

In the present embodiment, electric charge is supplied during the interval between the operation for printing one line and the operation for printing the next line. Obviously, in the initial stage of printing, ink is hardly electrically charged. Therefore, stable printing is permitted even from the first line by performing similar operations. Accordingly, as an initial operation, it is desired to apply charge supply pulses 305 immediately prior to printing.

In the present embodiment, a method of applying a voltage to all the print electrodes during the interval times, i.e., during when the auxiliary scan operation is being effected, is used. If a uniform potential difference is given between each print electrode 15 and the counter electrode 11, the ink is polarized according to this static electric field, and electric charge is accumulated on the surface. Therefore, similar advantages can be derived, for example, by connecting the charge supply means 32 with the counter electrode 11 and applying voltage pulses of a potential different from that applied to the print electrodes. Of course, the print electrode 15 and counter electrode 11 may be provided with their respective charge supply means, and voltages may be applied.

With respect to the structure of the charge supply means 32 and the method of supplying electric charge, the charge supply means 32 for producing constant-voltage pulses is mounted independently. Charge supply pulses 305 are applied to all the print electrodes according to the signal from the control circuit 36. This object can also be easily accomplished without using this structure. For example, in the present embodiment, image data is processed, and data for causing voltage pulses to be applied to all the print electrodes can be realized easily during the interval, i.e., until the print position goes to the next line by driving the print head.

In Embodiment 1, it is assumed that there is only one print head and that only one color is used, for simplicity of illustration. For example, plural print heads of the structure described above may be stacked. The heads may be sealed with different colors of ink. A full-color image may be resolved into basic color images. The heads may be controlled independently corresponding to the basic color images. With this method, high-quality color output can be derived. This concept may be similarly applied to the following embodiments.

(Embodiment 2)

Figure 4A:
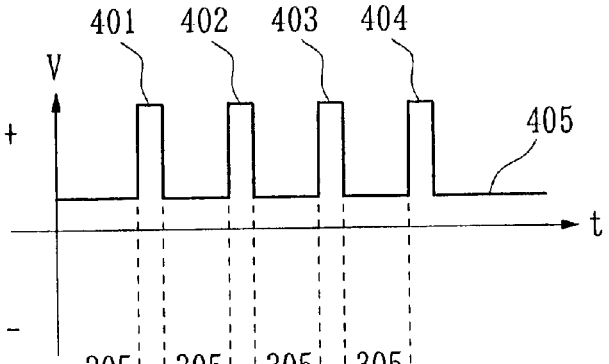
FIGS. 4A and 4B are timing charts illustrating a sequence of operations performed to drive a print head in accordance Embodiment 2 of the invention.
Figure 4B:
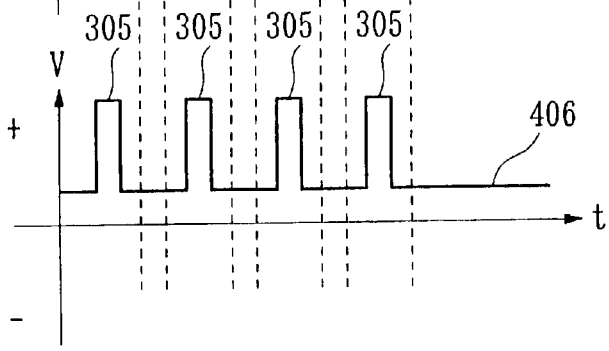

FIGS. 4A and 4B are timing charts illustrating a sequence of operations to drive a print head in accordance with Embodiment 2 of the invention. The operations are next described by referring to FIGS. 4A and 4B. Since the print head and the printer are similar in structure with the print head and the printer of Embodiment 1, they will not be described below. Fundamentally, the print head is so operated that one line is divided into four parts and that the print head operates according to the resulting four parts of line. For the sake of simplicity of illustration, print electrodes 15*a*–15*d* represent all print electrodes. Ink is squirted from all the print electrodes 15. The operation is next described.

FIG. 4A shows print pulses for unselected print electrodes 15 during printing operation. A print pulse 401 indicates a print pulse for activating the first print electrode 15*a* during printing operation. Similarly, print pulse 402 indicates a print pulse for activating the second print electrode 15*b*. Print pulse 403 indicates a print pulse for activating the third print electrode 15*c*. Print pulse 404 indicates a print pulse for activating the fourth print electrode 15*d*. Variations of these pulses taken on the time-axis (t) are indicated by 405.

FIG. 4B is a timing chart illustrating the operation of the charge supply means in accordance with the present embodiment. Charge supply pulses 305 are applied to all print electrodes 15. Variations of the voltage taken on the time-axis (t) are indicated by 406. These charge supply pulses 305 are successively applied before the print pulses for activating the print electrodes 15*a*–15*d* are applied during printing operation.

By operating the print head with the structure described thus far, electric charge is supplied to the ink with the charge supply pulses 305 applied before the print pulses are applied to the print head. Therefore, electric charge on the ink which is necessary to squirt the ink is maintained at all times. As a result, ink is squirted stably. High-quality output free from dropouts or thinned portions is accomplished. Since the ink has been already electrically charged, the ink can be squirted with a lower energy of print pulses than heretofore. Consequently, lower-voltage operation can be accomplished by setting the voltage lower. Alternatively, the print speed can be increased by shortening the pulse width.

In the present embodiment, a method of applying a voltage to all print electrodes during the intervals between successively applied print pulses is employed. If a uniform potential difference is given between each print electrode 15 and the counter electrode 11, the ink is polarized according to this static electric field, and electric charge is accumulated on the surface. Therefore, if the charge supply means 32 are connected with the counter electrode 11, and if voltage pulses of a potential different from that at the counter electrodes 11 are applied, similar advantages can be obtained. Of course, each print electrode 15 and the counter electrode 11 may be provided with their respective charge supply means to apply voltages.

With respect to the structure of the charge supply means 32 and the method of supplying electric charge in accordance with the present embodiment, the charge supply means 32 for generating constant-voltage pulses are mounted independently and apply the charge supply pulses 305 to all the print electrodes according to the signal from the control circuit 36. This object can also be easily accomplished without using this structure. For example, image data is processed, and data for causing voltage pulses to be applied to all the print electrodes is introduced during the intervals between successive print pulses in driving the print head.

Embodiment 1 can be used in combination. In consequence, during the sequence of print operations, the amount of electric charge on the ink is maintained at all times. Hence, stable output can be derived.

(Embodiment 3)

Figure 5A:
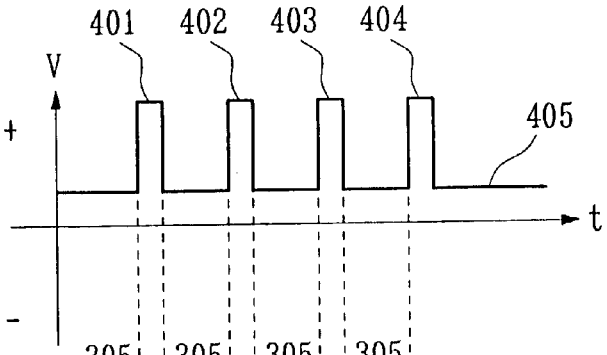
FIGS. 5A and 5B are timing charts illustrating a sequence of operations performed to drive a print head in accordance Embodiment 3 of the invention.
Figure 5B:
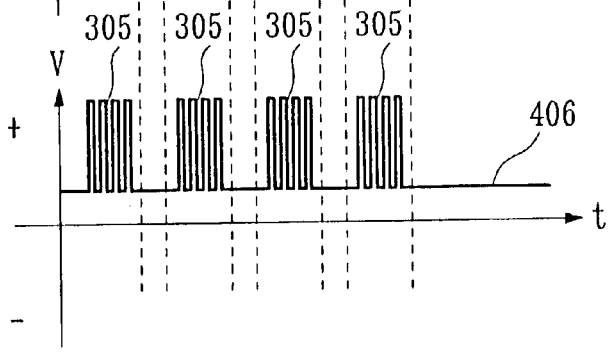

FIGS. 5A and 5B are timing charts illustrating a sequence of operations of a print head in accordance with Embodiment 3 of the present invention. The operation is next described by referring to FIGS. 5A and 5B.

The print head is assumed to divide each line to be printed into four parts and operate according to the four parts of line in the same way as in Embodiment 2. For the sake of simplicity of illustration, print electrodes 15*a*–15*d* represent all print electrodes in FIG. 5 in the same way as in Embodiment 2. Ink is squirted from all print electrodes 15. The operation is next described.

FIG. 5A shows print pulses for unselected print electrodes 15 during printing operation. In the same way as in Embodiment 2, print pulses 401–404 indicate print pulses for activating the first through fourth print electrodes 15*a*–15*d*, respectively, during printing operation. Variations of the voltage taken on the time-axis (t) are indicated by 405.

FIG. 5B is a timing chart illustrating the operation of the charge supply means in accordance with the present embodiment. Charge supply pulses 305 indicate charge supply pulses 305 applied to all print electrodes 15. Variations of the voltage taken on the time-axis (t) are indicated by 406. The charge supply pulses 305 are successively applied immediately before print pulses for activating print electrodes 15*a*–15*d* during the printing operation. In the present embodiment, each voltage pulse is divided into pulses 305 are applied immediately before print pulses are applied in the same way as in Embodiment 2.

By dividing the pulse width into plural parts and applying the narrower-width pulses successively, the amount of charge on the surface of meniscus can be controlled accurately. Furthermore, the dot diameter can be varied by adjusting the number of the charge supply pulses 305. For example, the concentration of the output image can be adjusted. In the case of an ink-printer using electrostatic force, it is readily affected by environmental factors such as temperature and moisture. Therefore, the environmental factors and the state of charge on the surface of the ink meniscus can be controlled using a surface potential sensor or the like and by a feedback technique. The number of applied charge supply pulses 305 is controlled. In this way, appropriate printing is accomplished.

In the present Embodiment 3, a voltage is applied to every print electrode during the interval between successively applied print pulses in the same way as in Embodiment 2. Similar advantages can be had by connecting the charge supply means 32 with the counter electrode 11 and applying voltage pulses at a potential different from that applied to the print electrodes to the counter electrode 11. Of course, each print electrode 15 and the counter electrode 11 may be provided with their respective charge supply means to apply voltages.

Embodiment 1 can be used in combination. In consequence, during the sequence of print operations, the amoument of electric charge on the ink is maintained at all times. Hence, stable output can be derived.

(Embodiment 4)

Figure 6:
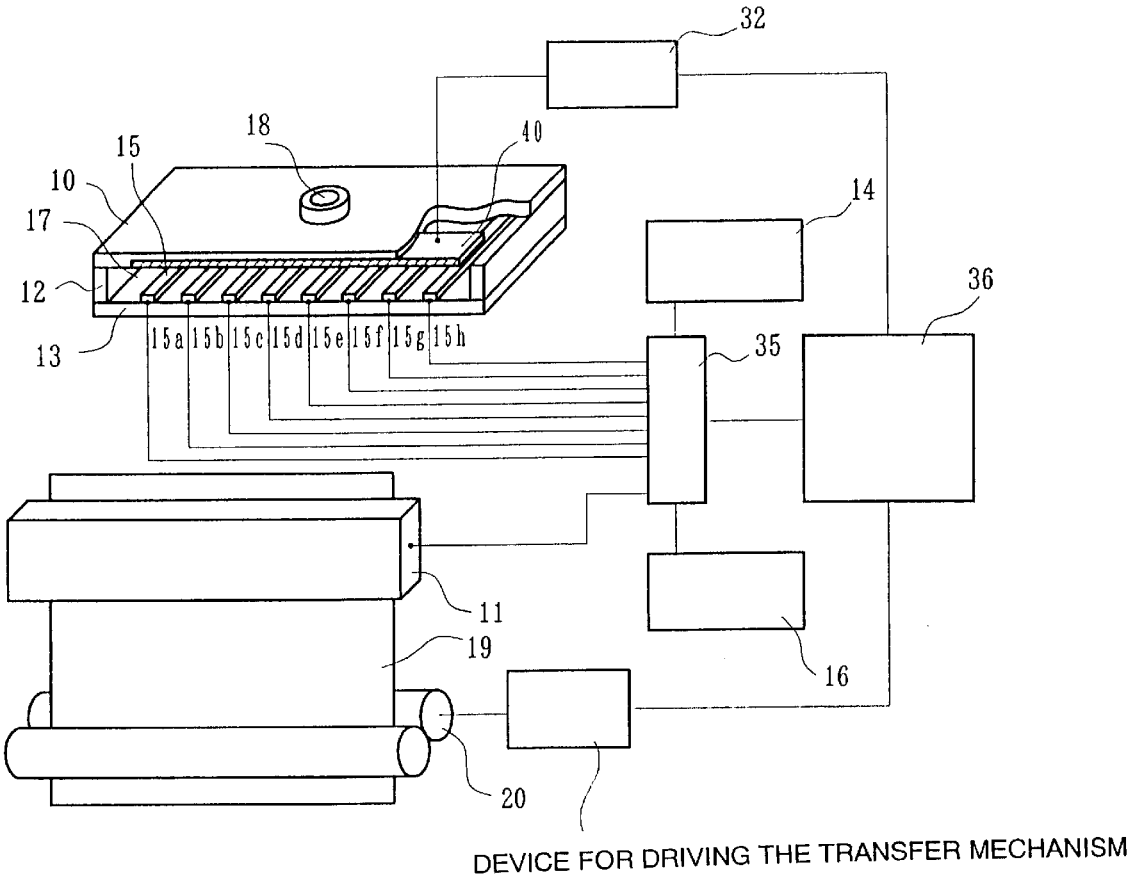
FIG. 6 is a block diagram showing another printer in accordance with the invention, as well as its print head.

FIG. 6 is a block diagram showing another structure of a printer in accordance with the invention, particularly showing its print head. The printer in accordance with the present Embodiment 4, particularly its print head, is described by referring to FIG. 6. The print head comprises an insulative lower head plate 13, a spacer 12 formed on the lower head plate 13, and an upper head plate 10 formed on the spacer 12. The spacer 12 has at least one side that is open and permits plural print electrodes 15 to be disposed at regular intervals on the lower head plate 13. In this structure, a slit opening 17 is formed at one end surface of the print head. An ink chamber is formed between the lower head plate 13 and the upper head plate 10. An auxiliary electrode 40 for supplying electric charge is formed on the insulative upper head plate 10 and located on the side of the inner surface of the ink chamber. The auxiliary electrode 40 spans at least an opening width over which dots can be printed near the opening. The auxiliary electrode is connected with the charge supply means 32 consisting of a pulse-generating circuit. The auxiliary electrode can apply desired voltage pulses in synchronism with the operation of the print electrodes under instructions from the control circuit 36.

The print head constructed in this way is made to apply charge supply pulses to the auxiliary electrode. The head is operated at the timing illustrated in Embodiments 1–3. In this way, their advantages can be derived. Unlike print electrodes successively spaced from each other longitudinally of the opening in the print head, the auxiliary electrode in accordance with the present embodiment can span the whole surface of the slit opening 17 almost continuously. Therefore, uniform charge can be supplied to ink. Moreover, the contact area with the ink can be varied flexibly. Consequently, the efficiency at which charge is supplied can be adjusted appropriately.

As described thus far, the present invention provides charge supply means for giving a uniform potential difference between each print electrode and the counter electrode before application of print pulses. Therefore, the following advantages can be derived.

(1) During intervals of printing operation, electric charge can be previously supplied to ink. Therefore, energy supplied during operation can be suppressed. Accordingly, the voltage of print pulses can be set lower. Alternatively, the pulse width can be shortened. As a result, the power supply can be reduced in size, which in turn permits miniaturization of the printer or increase in the print speed.

(2) Electric charge is supplied to the ink meniscus before printing under every condition. Therefore, the amount of electric charge on the ink before application of print pulses can be held constant at all times. Consequently, ink droplets are stably squirted without nonuniformities. High-quality printing can be done without nonuniformities or thinned portions under every condition. Also, the high quality can be maintained.

What is claimed is:

1. An ink-printer for electrostatically extracting ink from an opening formed in a print head to print on a recording medium, the ink-printer comprising:

a plurality of print electrodes disposed close to the opening;

a counter electrode closely spaced from the print electrodes and opposing the print electrodes via a narrow gap;

a driver circuit for selectively applying print pulses to the print electrodes to perform a printing operation by ejecting ink from the opening onto the recording medium; and charge supply means for supplying a desired electric charge to ink close to the opening between successive printing operations to maintain a charge on ink in the opening between the successive printing operations.

2. An ink-printer according to claim 1; further comprising a conveyor mechanism for conveying the recording medium between the counter electrode and the opening; wherein the charge supply means applies a uniform potential difference between each of the print electrodes and the counter electrode while the recording medium is being scanned by the conveyor means so as to supply an electric charge to the ink in the opening prior to the printing operation and between the successive printing operations.

3. An ink-printer according to claim 1; wherein the charge supply means applies voltage pulses to maintain a uniform potential difference between each of the print electrodes and the counter electrode immediately before application of the print pulses so as to supply an electric charge to the ink close to the opening prior to the printing operation and between the successive printing operations.

4. An ink-printer according to claim 1; wherein the charge supply means applies voltage pulses of a potential different from that applied to the counter electrode to all of the print electrodes so as to maintain a uniform potential difference between each of the print electrodes and the counter electrode.

5. An ink-printer according to claim 1; wherein the charge supply means applies a voltage pulse of a potential different from the potential applied to the print electrodes to the counter electrode so as to maintain a uniform potential difference between each of the print electrodes and the counter electrode.

6. An ink-printer according to claim 1; wherein the charge supply means applies equipotential voltage pulses to all of the print electrodes and, at the same time, applies a voltage pulse of a potential different from the potential of the voltage pulses applied to the print electrodes to the counter electrode so as to maintain a uniform potential difference between each of the print electrodes and the counter electrode.

7. An ink-printer according to claim 1; further comprising a feeding electrode for supplying electric charge to a surface which is close to the opening and which makes contact with the ink; wherein the charge supply means applies a voltage pulse of a potential different from the potential applied to the counter electrode to the feeding electrode so as to maintain a uniform potential difference between each of the print electrodes and the counter electrode.

8. An ink-printer according to claim 1; wherein adjacent ones of the print electrodes are not selected simultaneously.

9. An ink-printer according to claim 1; wherein the potential difference between each selected one of the print electrodes and the counter electrode is made different from the potential difference between each unselected one of the electrodes and the counter electrode.

10. A print head comprising: means defining an opening; a liquid chamber for containing ink and communicating with the opening; a plurality of electrodes arranged proximate the opening; a driving circuit for applying voltages to selected electrodes so that an electrostatic force is exerted to the ink to perform printing operations by ejecting the ink from the opening portion onto a recording medium at a position of the selected electrodes; and a charge supply circuit for applying a charge to ink contained near the opening prior to performing each printing operation.

11. A print head according to claim 10; wherein the electrodes comprise a plurality of printing electrodes arranged near the opening; and a counter electrode opposed from the printing electrodes.

12. A print head according to claim 11; wherein the charge supply circuit applies a uniform potential difference between each of the printing electrodes and the counter electrode while the recording medium is being scanned therebetween so as to supply an electric charge to the ink in the opening prior to performing a printing operation and between successive printing operations.

13. A print head according to claim 11; wherein the charge supply circuit applies voltage pulses to maintain a uniform potential difference between each of the print electrodes and the counter electrode immediately before application of print pulses to the printing electrodes so as to supply an electric charge to the ink close to the opening prior to performing a printing operation and between successive printing operations.

14. A print head according to claim 11; wherein the charge supply circuit applies voltage pulses to all of the printing electrodes, the voltage pulses having a potential different from that applied to the counter electrode, so as to maintain a uniform potential difference between each of the printing electrodes and the counter electrode.

15. A print head according to claim 11; wherein the charge supply means applies a voltage pulse to the counter electrode, the voltage pulse having a potential different from that applied to the printing electrodes, so as to maintain a uniform potential difference between each of the printing electrodes and the counter electrode.

16. A print head according to claim 11; wherein the charge supply circuit applies equipotential voltage pulses to all of the printing electrodes and, at the same time, applies a voltage pulse having a different potential from that of the voltage pulses applied to the printing electrodes to the counter electrode so as to maintain a uniform potential difference between each of the printing electrodes and the counter electrode.

17. A print head according to claim 11; further comprising an auxiliary electrode for supplying electric charge to a surface close to the opening and in contact with the ink; wherein the charge supply circuit applies a voltage pulse of a potential different from the potential applied to the counter electrode to the auxiliary electrode so as to maintain a uniform potential difference between each of the printing electrodes and the counter electrode.

18. A print head according to claim 11; wherein the drive circuit selects the printing electrodes so that adjacent printing electrodes are not selected simultaneously.

19. A print head according to claim 11; wherein the potential differences between selected printing electrodes and the counter electrode differs from potential differences between unselected printing electrodes and the counter electrode.

20. A method of printing using an electrostatic printer having a print head which performs a printing operation by ejecting ink from an opening in response to application of a voltage to selected printing electrodes provided near the opening and a counter electrode opposing the printing electrodes to print on a recording medium interposed between the printing electrodes and the counter electrode, the method comprising the steps of:

selectively applying print pulses to the printing electrodes to perform a printing operation on the recording medium; and supplying an electric charge to ink close to the opening to maintain a charge on ink in the opening prior to a printing operation and between successive printing operations.

* * * * *